US011231673B2

(12) United States Patent
Koehler et al.

(10) Patent No.: US 11,231,673 B2
(45) Date of Patent: Jan. 25, 2022

(54) OPERATIONAL PROFILES OF PRINTING DEVICE COMPONENTS

(71) Applicant: Hewlett-Packard Development Company, L.P., Spring, TX (US)

(72) Inventors: Duane A Koehler, Vancouver, WA (US); Trevor Eric Hendricks, Vancouver, WA (US); Benjamin Whitney Griffith, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 56 days.

(21) Appl. No.: 16/606,631

(22) PCT Filed: Apr. 21, 2017

(86) PCT No.: PCT/US2017/028892
§ 371 (c)(1),
(2) Date: Oct. 18, 2019

(87) PCT Pub. No.: WO2018/194666
PCT Pub. Date: Oct. 25, 2018

(65) Prior Publication Data
US 2021/0109471 A1 Apr. 15, 2021

(51) Int. Cl.
*G03G 15/00* (2006.01)

(52) U.S. Cl.
CPC ..... *G03G 15/5037* (2013.01); *G03G 15/5004* (2013.01); *G03G 15/80* (2013.01)

(58) Field of Classification Search
USPC ..... 399/48
See application file for complete search history.

(56) References Cited

U.S. PATENT DOCUMENTS

| | | | | |
|---|---|---|---|---|
| 8,045,876 | B2 | 10/2011 | Takagi et al. | |
| 8,238,774 | B2 | 8/2012 | Takeda | |
| 10,606,199 | B1 * | 3/2020 | Antonio | G03G 15/5004 |
| 2005/0002681 | A1 * | 1/2005 | Takahashi | G03G 15/5037 399/50 |
| 2009/0165329 | A1 | 7/2009 | Reichelsheimer et al. | |
| 2010/0080593 | A1 * | 4/2010 | Inukai | G03G 15/0291 399/50 |
| 2013/0195480 | A1 * | 8/2013 | Kondo | G03G 15/0258 399/34 |
| 2014/0090267 | A1 | 4/2014 | Walker et al. | |
| 2017/0031260 | A1 * | 2/2017 | Ikada | G03G 21/08 |

FOREIGN PATENT DOCUMENTS

| | | |
|---|---|---|
| WO | WO-2013/113372 A1 | 8/2013 |
| WO | WO-2016/097911 A1 | 6/2016 |

OTHER PUBLICATIONS

Canon LBP5050 Series Service Manual < https://www.manualslib.com/manual ~ 5 pages ~ 2012-2017.

* cited by examiner

*Primary Examiner* — Quana Grainger
(74) *Attorney, Agent, or Firm* — Brooks Cameron & Huebsch PLLP

(57) ABSTRACT

In some examples, a controller can generate operational profiles of printing device components by determining an electrical measurement of a component of a printing device, generate an operational profile of the electrical measurement, compare the operational profile against a baseline operational profile the component, and generate an alert based on the comparison.

14 Claims, 5 Drawing Sheets

OPERATIONAL PROFILES OF PRINTING DEVICE COMPONENTS

BACKGROUND

Printing devices may have various components with specific power needs. Some components are powered by, for instance, alternating current (AC). For example, a conditioner of a printing device may be powered by AC, and AC delivery to power various sub-components of the conditioner may have to be synchronized. Scheduling and managing the power delivery to various components of the printing device can depend on the components of the printing device functioning properly.

DETAILED DESCRIPTION

Synchronizing power delivery to components of a printing device can allow a printing device to work efficiently. For example, synchronizing power to a conditioner of the printing device can allow a heated pressure roller (NPR) of the conditioner to efficiently condition ink applied to paper as the paper passes through the conditioner.

Printing device components may not function properly in some instances. For example, if a printing device component is faulty, delivery of power to the component may be higher than expected. This may cause a circuit of the printing device to be overloaded. In some instances, various regulatory rules may not be satisfied.

Operational profiles of printing device components can allow for electrical measurements of components of the printing device to be taken. The electrical measurements may allow for detection and/or diagnosis of anomalies and/or component faults. Detection of anomalies and/or component faults can be detected before causing a system failure. As a result, printing device efficiency may be maintained or increased, while reducing support costs and providing reliability to a printing device customer.

Figure 1:
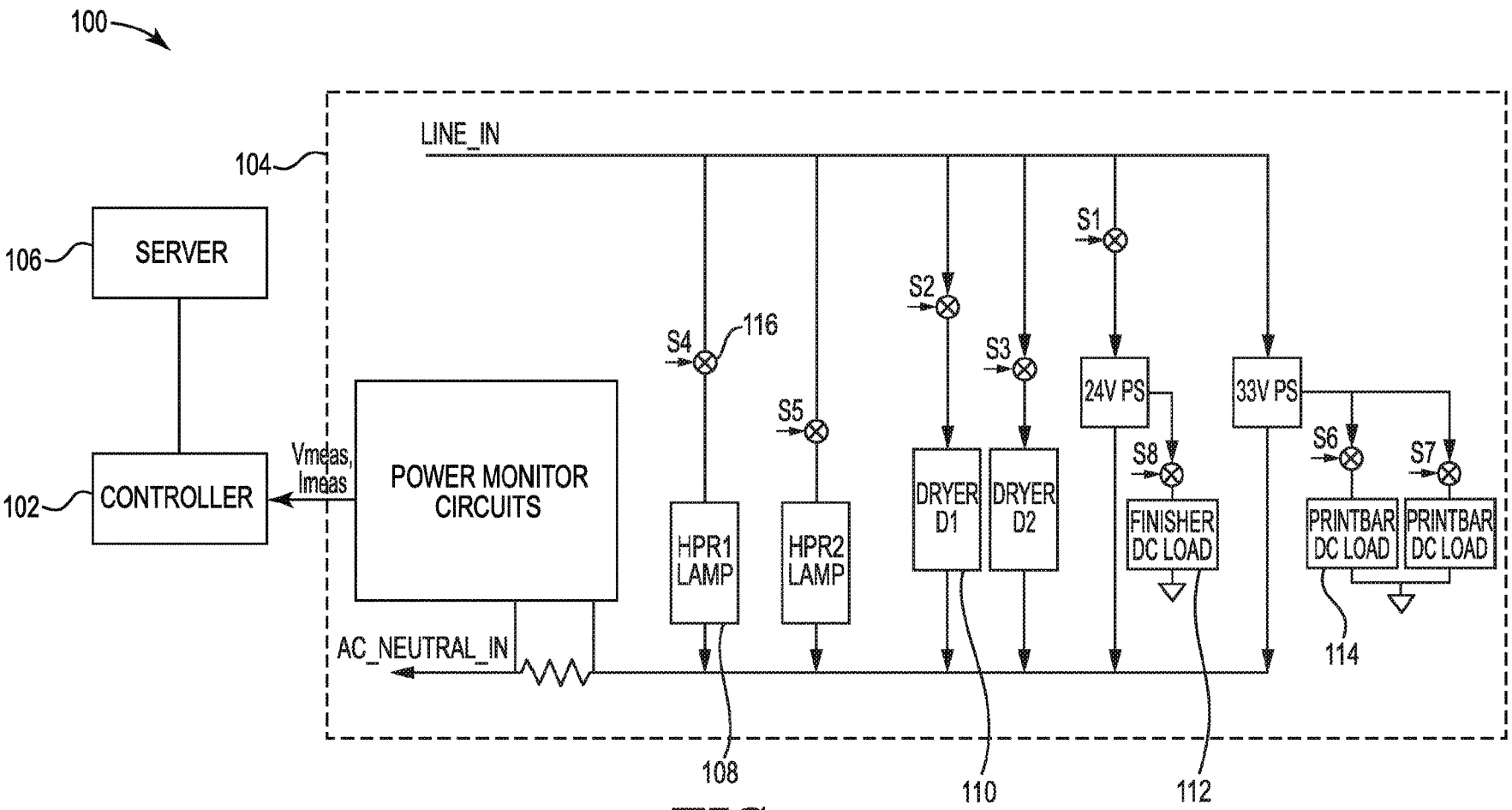
FIG. 1 illustrates an example of a system suitable for operational profiles of printing device components consistent with the disclosure.

FIG. 1 illustrates an example of a system 100 suitable for operational profiles of printing device components consistent with the disclosure. System 100 can include a controller 102, a printing device circuit 104, and a server 106. Printing device circuit 104 can include HPR lamp 108, dryer 110, finisher 112, print bar 114, and switch 116.

As shown in FIG. 1, system 100 can include a controller 102 and a printing device circuit 104. Controller 102 and printing device circuit 104 can be included in a printing device. For example, a printing device may include controller 102 and printing device circuit 104. As used herein, the term "printing device" may refer to a device which can generate a human-readable representation of graphics or text on paper or other physical media.

In some examples, controller 102 can be remote from the printing device. For example, controller 102 may not be included in the printing device, but may be located remotely from the printing device. The printing device and the controller 102 may be interconnected. As used herein, the term "interconnect" or used descriptively as "interconnected" can, for example, refer to a communication pathway established over an information-carrying medium. The "interconnect" may be a wired interconnect, wherein the medium is a physical medium (e.g., electrical wire, optical fiber, cable, bus traces, etc.), a wireless interconnect (e.g., air in combination with wireless signaling technology) or a combination of these technologies.

In some examples, controller 102 and the printing device can be wirelessly interconnected via a network relationship. As used herein, the term "network relationship" can, for example, refer to a local area network (LAN), a virtual local area network (VLAN), wide area network (WAN), personal area network (PAN), a distributed computing environment (e.g., a cloud computing environment), storage area network (SAN), Metropolitan area network (MAN), a cellular communications network, and/or the Internet, among other types of network relationships.

Controller 102 can determine an electrical measurement of a component of a printing device. As used herein, the term "electrical measurement" can, for example, refer to a calculation and/or method used to measure an electrical quantity. As used herein, the term "component" can, for example, refer to a constituent part of a system. For example, controller 102 can determine an electrical measurement of HPR lamp 108, dryer 110, finisher 112, print bar 114, and/or switch 116, among other components of the printing device.

An electrical measurement can include a voltage measurement of the component of the printing device and/or a current measurement of the component of the printing device. As used herein, voltage can refer to a difference in electric potential energy between two points per unit electric charge. As used herein, current can refer to a flow of electric charge. For example, controller 102 can determine a voltage measurement and/or a current measurement of HPR lamp 108, dryer 110, finisher 112, print bar 114, and/or switch 116, among other components of the printing device.

As used herein, an HPR lamp may refer to a lamp, such as a halogen lamp, that can supply heat to an HPR. An HPR may refer to a roller to a roller which can apply pressure and/or heat to post-printed media to dry and/or otherwise condition the media for output finishing. As used herein, a dryer may refer to a device that can apply heat and/or airflow to assist in evaporation of moisture from post-print media. As used herein, a power supply may refer to a device that can supply electrical energy to an electrical load. As used herein, a print bar may refer to a device that can use electrical pulses to deliver ink drops across a width of the print media in order to form an image on the print media. As used herein, a finisher may refer to a device that can provide finishing features to print media, such as stacking, stapling, collation, and/or hole punching, among other finishing features. As used herein, a switch may refer to a device that can remove or restore a conducting path in a circuit.

Controller 102 can determine an electrical measurement of a component of a printing device at different operational modes of the printing device, as is further described in connection with FIG. 2. For example, controller 102 can determine an electrical measurement of a component of the printing device during a sleep mode of the printing device, a wake up period of the printing device, and/or during operation of the printing device, although examples of the disclosure are not limited to a sleep mode, wake up period, and/or operation of the printing device. For example, operational modes can include hibernation and/or hybrid sleep modes, among other operational modes. As used herein, the term "sleep mode" can, for example, refer to a low power mode of an electronic device. As used herein, the term "wake up period" can, for example, refer to an operational mode between a sleep mode and operation of the printing device. As used herein, the term "operation of the printing device" can, for example, refer to a powered state of the printing device where the printing device can perform print jobs.

Controller 102 can generate an operational profile of the electrical measurement. An operational profile can be an electrical measurement measured over time. For example, controller 102 can generate an operational profile of a voltage and/or current measurement of HPR lamp 108 over time. The operational profile can include voltage and/or current measurements of HPR lamp 108, measured at various points in time. The voltage and/or current measurement of HPR lamp 108 may be measured during operation of the printing device at the various points in time.

As another example, controller 102 can generate an operational profile of a voltage and/or current measurement of dryer 110. The voltage and/or current measurement of dryer 110 may be measured during operation of the printing device at various points in time.

Although electrical measurements are described above as being measured during operation of the printing device at various points in time, examples of the disclosure are not so limited. For example, controller 102 can generate an operational profile of electrical measurements at various in points in time taken during various operational modes. For instance, it may be beneficial to measure electrical measurements of a motor during a sleep mode of the printing device while the motor is in thermal equilibrium with the environment surrounding the printing device, as the electrical measurements of some components, such as the motor, may be a function of temperature.

Controller 102 can transmit the generated operational profile to server 106. Controller 102 and server 106 can be interconnected (e.g., via a network relationship). For example, controller 102 can transmit generated operational profiles of various components of the printing device to server 106 for storage, as is further described in connection with FIG. 5.

Controller 102 can compare the generated operational profile against a baseline operational profile of the component. The baseline operational profile of the component can be an operational profile against which the generated operational profile may be compared. The comparison of the generated operational profile and the baseline operational profile can provide an indication as to whether the component of the printing device is working as expected or not. For example, if a component of the printing device is not operating in a way that is expected, the comparison of the generated operational profile with the baseline operational profile may provide an early warning of a fault of the component, as is further described herein.

In some examples, the baseline operational profile can be an electrical measurement of the component of the printing device measured over time when the component is manufactured. For example, the baseline operational profile may be an operational profile measured after the component is manufactured to provide an indication as to how the component operates when new/newly manufactured. The baseline operational profile measured after the component is manufactured may be measured by the manufacturer of the component, although examples of the disclosure are not so limited.

In some examples, the baseline operational profile can be an electrical measurement of the component of the printing device measured over time when the component is installed in the printing device. For example, the baseline operational profile may be an operational profile measured after the component is installed in the printing device to provide an indication as to how the component operates when newly installed in the printing device.

Controller 102 can determine a voltage and/or current measurement of HPR lamp 108 to be a first voltage, and controller 102 can generate an operational profile of the voltage and/or current measurement of HPR lamp 108 based on the first voltage. As described above, an HPR lamp may utilize a halogen lamp with a particular filament. The halogen lamp may behave according to a halogen cycle, where the filament develops thinner regions where hottest while in use, eventually thinning to the point where it can fail.

Electrical resistance of the filament can be a function of the length of the filament and the cross-sectional area of the filament, and the electrical resistance of the filament may be determined based on the voltage and/or current measurement of HPR lamp 108. Controller 102 can compare the generated operational profile of the voltage and/or current measurement of HPR lamp 108 (e.g., the first voltage) against a baseline operational profile of a voltage and/or current measurement of HPR lamp 108 (e.g., a second voltage), where the second voltage and/or current may be measured when the filament of HPR lamp 108 is newly manufactured or newly installed in the printing device.

Controller 102 can record the operational profile as an anomaly in response to the operational profile exceeding a first threshold. As used herein, the term "anomaly" can, for example, refer to an operational profile that may indicate the component of the printing device is not working as expected. Controller 102 can record the time and/or the date of the anomaly.

Continuing with the example from above, if the first voltage of the generated operational profile exceeds the second voltage of the baseline operational profile by a first threshold amount, controller 102 can record the generated operational profile as an anomaly, including recording the time and/or date of the anomaly. The first threshold can be, for example, ±20% of the baseline operational profile voltage, among other threshold amounts. For example, if the first voltage of the generated operational profile exceeds the second voltage of the baseline operational profile by ±20%, controller 102 can record the generated operational profile as an anomaly. In some examples, the first threshold amount can be configurable.

If the first voltage of the generated operational profile exceeds the second voltage of the baseline operational profile by a second threshold amount, controller 102 can record the generated operational profile, and determine the operational profile indicates a fault of the component of the printing device. The second threshold can be, for example, ±30% of the baseline operational profile voltage, among other threshold amounts. For example, if the first voltage of the generated operational profile exceeds the second voltage of the baseline operational profile by ±30%, controller 102 can record the generated operational profile, and determine the operational profile indicates a fault of HPR lamp 108. A fault can indicate HPR lamp 108 may have failed and may have to be repaired or replaced. In some examples, the second threshold amount can be configurable.

Although controller 102 is described above as comparing a generated operational profile against a baseline operational profile for an HPR lamp, examples of the disclosure are not so limited. For example, controller 102 can compare a generated operational profile against a baseline operational profile for other components of the printing device.

Controller 102 can generate an alert based on the comparison of the generated operational profile and the baseline operational profile. That is, controller 102 can generate an alert in response to the operational profile indicating the fault the component of the printing device. The generated alert can be displayed, by, for example, a user interface of the printing device. The generated alert can inform a user that there is a fault with a component of the printing device.

In some examples, the alert can be transmitted to service support. For example, the generated alert may be transmitted to technical support so that the component of the printing device may be repaired or replaced.

Operational profiles of printing device components can allow for detection and/or diagnosis of anomalies and/or component faults. Anomalies may be recognized prior to a component fault, allowing for monitoring and/or replacement of the component prior to component fault. Further, detection of anomalies and/or component faults can be detected before causing a system failure. Operational profiles of printing device components can provide printing device efficiency to be maintained or increased, can reduce support costs, and can provide reliability to a printing device customer.

Figure 2:
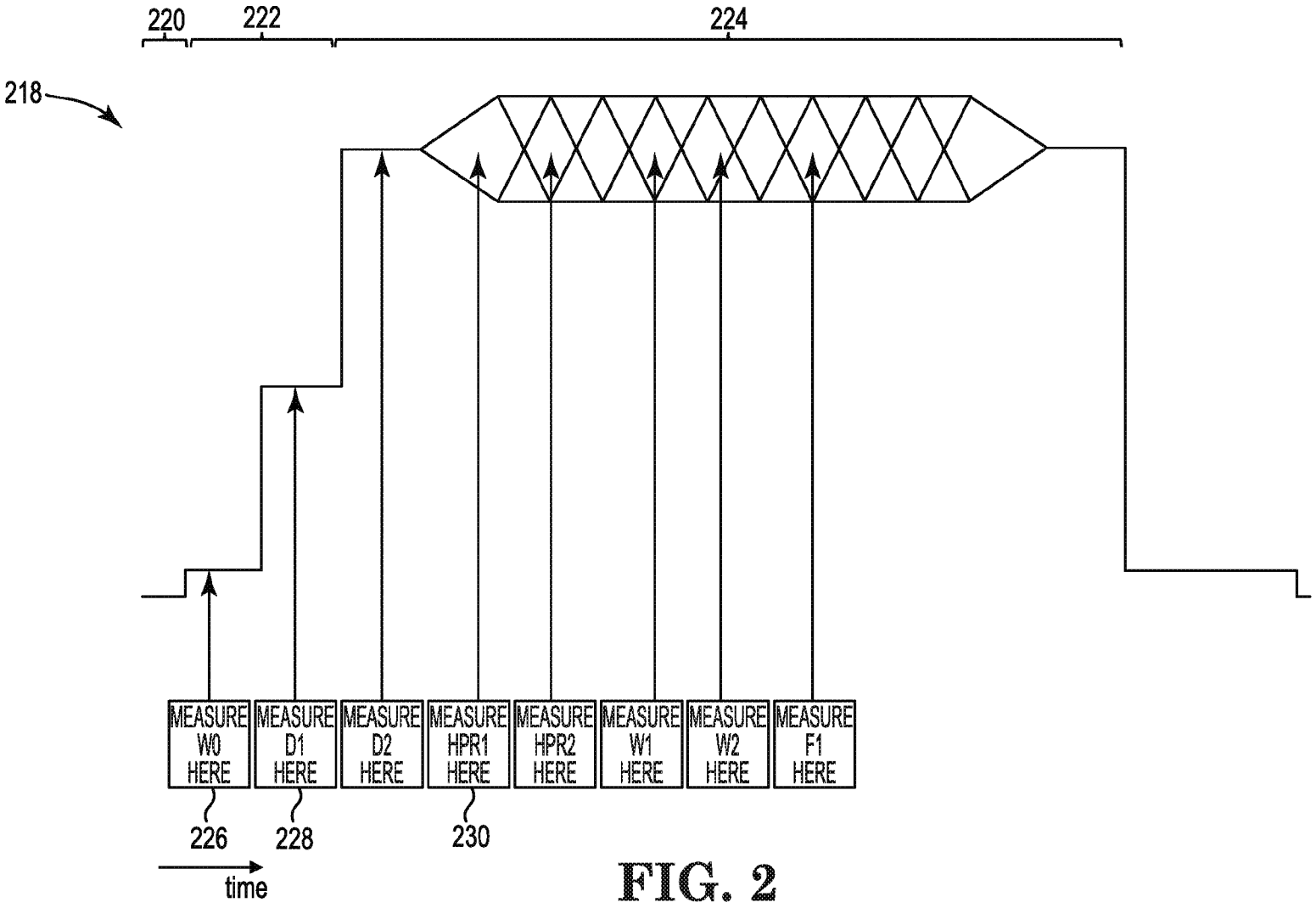
FIG. 2 illustrates an example of a printing device power profile consistent with the disclosure.

FIG. 2 illustrates an example of a printing device power profile 218 consistent with the disclosure. Printing device power profile 218 can include sleep mode 220, wake-up period 222, operation of the printing device mode 224, first electrical measurement 226, second electrical measurement 228, and third electrical measurement 230.

Printing device power profile 218, as illustrated in FIG. 2, can show an order of electrical measurements as a printing device transitions from a sleep mode 220, through a wake-up period 222, to an operation of the printing device mode 224. The order of electrical measurements can be on a time scale. For example, as time passes, the printing device can transition from sleep mode 220 through wake-up period 222 to operation of the printing device mode 224.

A controller (e.g., controller 102, previously described in connection with FIG. 1) can determine electrical measurements of components of the printing device in a predetermined sequence such that each of the electrical measurements are determined at different times. For example, as shown in FIG. 2, first electrical measurement 226 can occur at a first time while the printing device is in wake-up period 222. Second electrical measurement 228 can occur at a second time while the printing device is in wake-up mode 222. Third electrical measurement 230 can occur at a third time while the printing device is in operation of the printing device mode 224. The first time corresponding to first electrical measurement 226, the second time corresponding to second electrical measurement 228, and the third time corresponding to third electrical measurement 230 can be different times, as illustrated in FIG. 2.

The controller can generate operational profiles of each electrical measurement in the predetermined sequence. That is, the controller can generate operational profiles for first electrical measurement 226, second electrical measurement 228, and third electrical measurement 230. As described in connection with FIG. 1, the controller can generate an operational profile of first electrical measurement 226, an operational profile of second electrical measurement 228, and an operational profile of third electrical measurement 230. The controller can transmit the operational profiles for first electrical measurement 226, second electrical measurement 228, and third electrical measurement 230 to a server (e.g., server 106, previously described in connection with FIG. 1.

Figure 3:
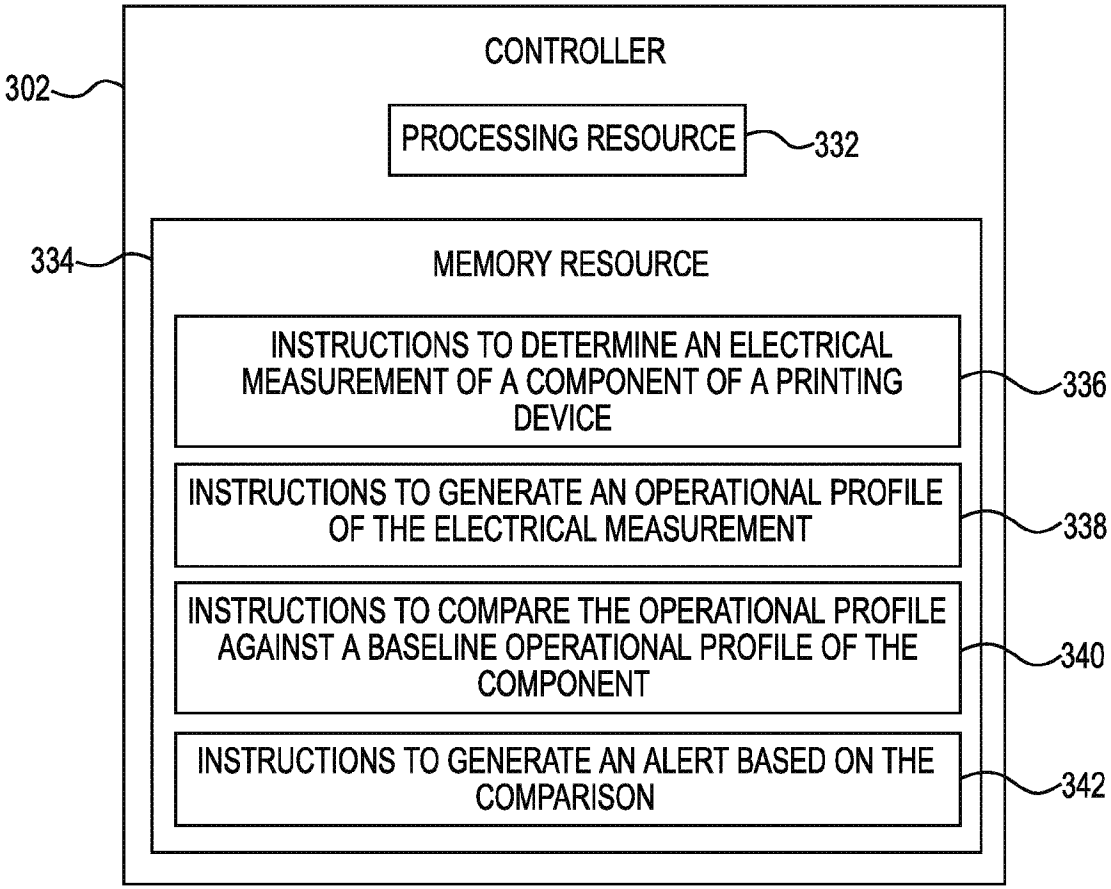
FIG. 3 illustrates a block diagram of an example of a controller consistent with the disclosure.

FIG. 3 illustrates a block diagram of an example of a controller 302 consistent with the disclosure. Controller 302 (e.g., controller 102, previously described in connection with FIG. 1) can include a processing resource 332 and a memory resource 334. Memory resource 334 can include machine readable instructions, including determine an electrical measurement instructions 336, generate an operational profile instructions 338, compare instructions 340, and generate an alert instructions 342.

Processing resource 332 may be a central processing unit (CPU), a semiconductor based microprocessor, and/or other hardware devices suitable for retrieval and execution of machine-readable instructions 336, 338, 340, 342 stored in a memory resource 334. Processing resource 332 may fetch, decode, and execute instructions 336, 338, 340, 342. As an alternative or in addition to retrieving and executing instructions 336, 338, 340, 342, processing resource 332 may include a plurality of electronic circuits that include electronic components for performing the functionality of instructions 336, 338, 340, 342.

Memory resource 334 may be any electronic, magnetic, optical, or other physical storage device that stores executable instructions 336, 338, 340, 342 and/or data. Thus, memory resource 334 may be, for example, Random Access Memory (RAM), an Electrically-Erasable Programmable Read-Only Memory (EEPROM), a storage drive, an optical disc, and the like. Memory resource 334 may be disposed within controller 302, as shown in FIG. 3. Additionally and/or alternatively, memory resource 334 may be a portable, external or remote storage medium, for example, that allows controller 302 to download the instructions 336, 338, 340, 342 from the portable/external/remote storage medium.

Processing resource 332 may execute determine an electrical measurement instructions 336 stored in memory resource 334 to determine an electrical measurement of a component of a printing device. Components of a printing device can include an HPR lamp (e.g., HPR lamp 108, previously described in connection with FIG. 1), dryer (e.g., dryer 110, previously described in connection with FIG. 1), finisher (e.g., finisher 112, previously described in connection with FIG. 1), print bar (e.g., print bar 114, previously described in connection with FIG. 1), switch (e.g., switch 116, previously described in connection with FIG. 1), and/or a power supply, among other components of a printing device. Electrical measurements can include a voltage measurement and/or a current measurement.

Processing resource 332 may execute generate an operational profile instructions 338 stored in memory resource 334 to generate an operational profile of the electrical measurement. An operational profile can be an electrical measurement measured over time.

Processing resource 332 may execute compare instructions 340 stored in memory resource 334 to compare the operational profile against a baseline operational profile of the component. The operational profile can be compared against a baseline operational profile to determine whether a component of the printing device is working as expected. In some examples, if the operational profile exceeds the baseline operational profile by a first threshold amount, controller 302 can record the generated operational profile as an anomaly. In some examples, if the operational profile exceeds the baseline operational profile by a second threshold amount (where the first threshold amount and second threshold amount are different), controller 302 can record the generated operational profile and determine the operational profile indicates a fault of the component of the printing device.

Processing resource 332 may execute generate an alert instructions 342 stored in memory resource 334 to generate an alert based on the comparison. The alert may be used to notify a user of the fault of the component of the printing device.

Figure 4:
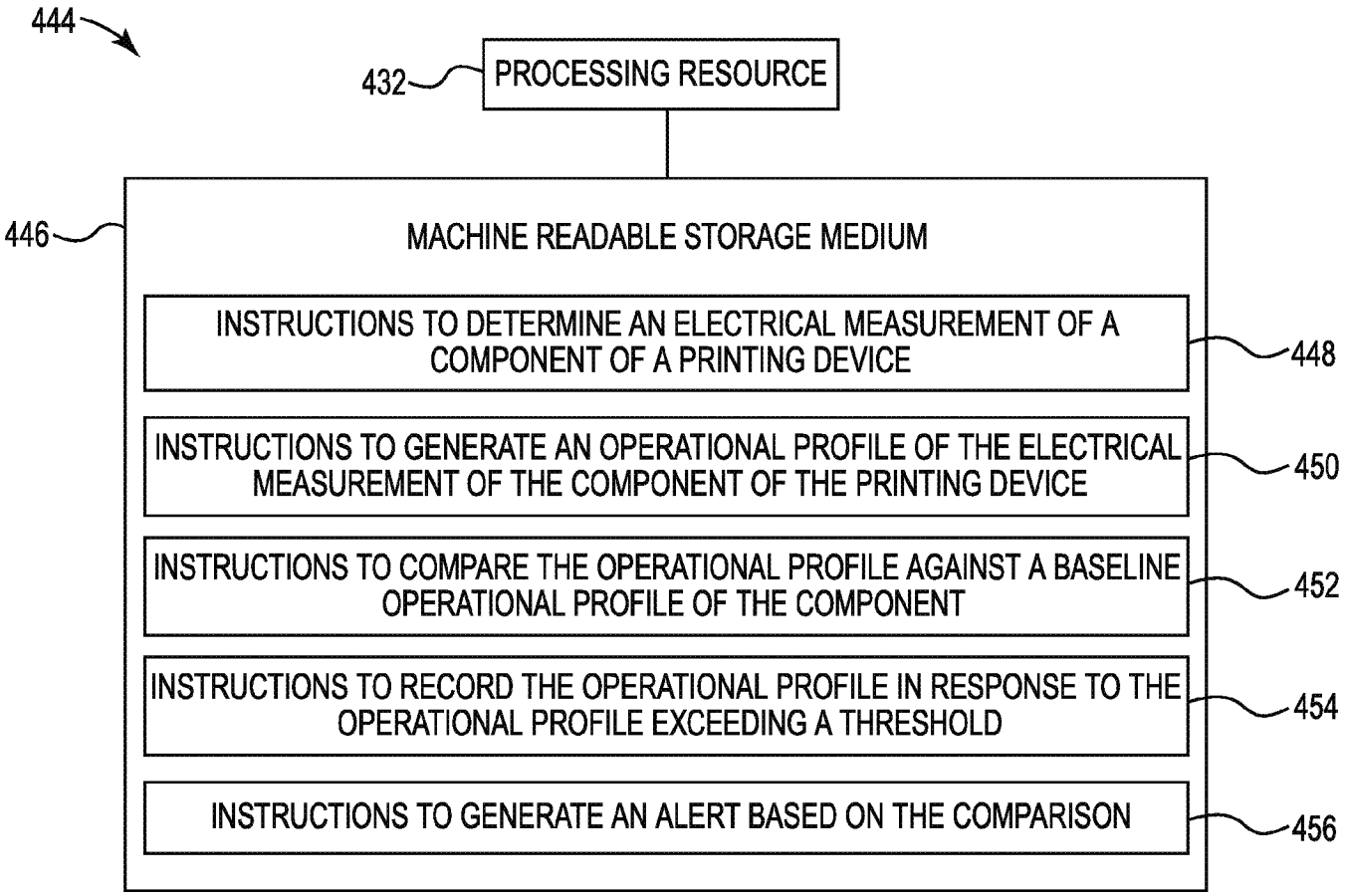
FIG. 4 illustrates a block diagram of an example of a system suitable for operational profiles of printing device components consistent with the disclosure.

FIG. 4 illustrates a block diagram of an example of a system 444 suitable for operational profiles of printing device components consistent with the disclosure. In the example of FIG. 4, system 444 includes a processing resource 432 (e.g., processing resource 332, previously described in connection with FIG. 3) and a machine readable storage medium 446. Although the following descriptions refer to an individual processing resource and an individual machine readable storage medium, the descriptions may also apply to a system with multiple processing resources and multiple machine readable storage mediums. In such examples, the instructions may be distributed across multiple machine readable storage mediums and the instructions may be distributed across multiple processing resources. Put another way, the instructions may be stored across multiple machine readable storage mediums and executed across multiple processing resources, such as in a distributed computing environment.

Processing resource 432 may be a central processing unit (CPU), microprocessor, and/or other hardware device suitable for retrieval and execution of instructions stored in machine readable storage medium 446. In the particular example shown in FIG. 4, processing resource 432 may receive, determine, and send instructions 448, 450, 452, 454, and 456. As an alternative or in addition to retrieving and executing instructions, processing resource 432 may include an electronic circuit comprising an electronic component for performing the operations of the instructions in machine readable storage medium 446. With respect to the executable instruction representations or boxes described and shown herein, it should be understood that part or all of the executable instructions and/or electronic circuits included within one box may be included in a different box shown in the figures or in a different box not shown.

Machine readable storage medium 446 may be any electronic, magnetic, optical, or other physical storage device that stores executable instructions. Thus, machine readable storage medium 446 may be, for example, Random Access Memory (RAM), an Electrically-Erasable Programmable Read-Only Memory (EEPROM), a storage drive, an optical disc, and the like. The executable instructions may be "installed" on the system 444 illustrated in FIG. 4. Machine readable storage medium 446 may be a portable, external or remote storage medium, for example, that allows the system 444 to download the instructions from the portable/external/remote storage medium. In this situation, the executable instructions may be part of an "installation package". As described herein, machine readable storage medium 446 may be encoded with executable instructions related to operational profiles of printing device components. That is, using processing resource 432, machine readable storage medium 446 may instruct a controller to generate operational profiles of printing device components, among other operations.

Instructions 448 to determine an electrical measurement of a component of a printing device, when executed by processing resource 432, may cause system 444 to determine an electrical measurement of a component of a printing device. System 444 can determine a voltage and/or current measurement of a component of a printing device.

Instructions 450 to generate an operational profile, when executed by processing resource 432, may cause system 444 to generate an operational profile of the electrical measurement of the component of the printing device.

Instructions 452 to compare the operational profile against a baseline operational profile of the component, when executed by processing resource 432, may cause system 444 to compare the generated operational profile against a baseline operational profile of the component. The operational profile can be compared against a baseline operational profile of the component to determine whether the component of the printing device is working as expected.

Instructions 454 to record the operational profile, when executed by processing resource 432, may cause system 444 to record the operational profile in response to the operational profile exceeding a threshold. As described in connection with FIG. 1, there can be various threshold levels that may cause system 444 to record the generated operational profile as an anomaly or to determine the operational profile indicates a fault of the component of the printing device, among other actions.

Instructions 456 generate an alert, when executed by processing resource 432, may cause system 444 to generate an alert based on the comparison. The alert may be used to notify a user of the fault of the component of the printing device.

Figure 5:
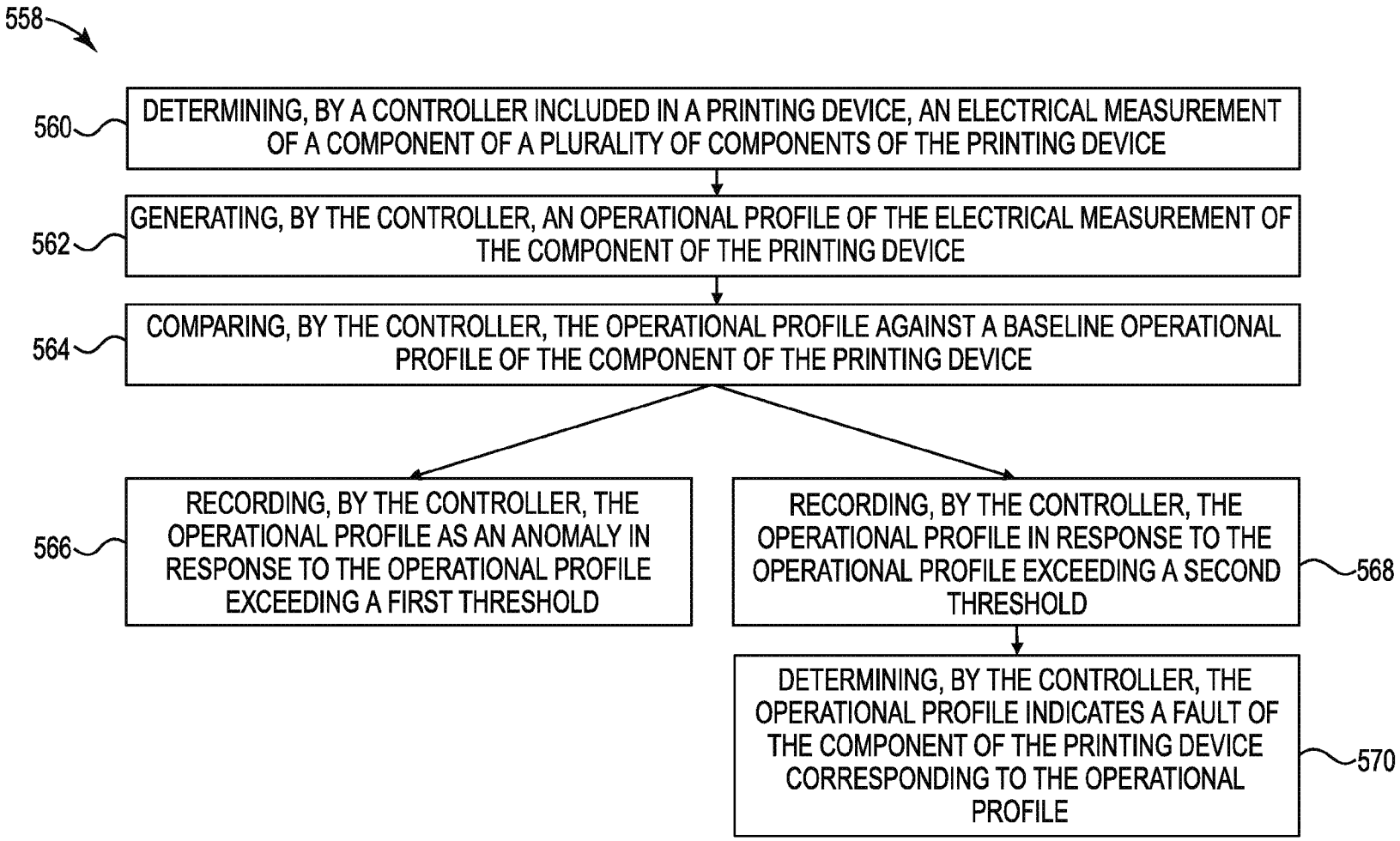
FIG. 5 illustrates an example of a method for operational profiles of printing device components consistent with the disclosure.

FIG. 5 illustrates an example of a method 558 for operational profiles of printing device components consistent with the disclosure. For example, method 558 can be performed by a controller (e.g., controller 102, 302, previously described in connection with FIGS. 1 and 3, respectively).

At 560, the method 558 includes determining, by a controller included in a printing device, an electrical measurement of a component of a plurality of components of the printing device. The controller can determine voltage and/or current measurements of various components of a printing device, such as HPR lamps, dryers, finishers, print bars, switches, and/or power supplies, among other components of a printing device, as described in connection with FIG. 1.

At 562, the method 558 includes generating, by the controller, an operational profile of the electrical measurement of the component of the printing device. The operational profile can be an electrical measurement measured over time.

In some examples, method 558 can include transmitting the generated operational profile of the electrical measurement of the component of the printing device to a server (e.g., server 106, previously described in connection with FIG. 1). The server can aggregate operational profiles of electrical measurements of various components from other printing devices. The aggregated operational profiles may be utilized by a printing device as baseline operational profiles to compare with operational profiles generated by a printing device, as is further described herein.

In some examples, method 558 can include receiving an operational profile from a database of operational profiles. The database of operational profiles may be stored on the server. In some examples, the received operational profile can correspond to an electrical measurement of a same component type from a different printing device as the component of the printing device. For example, the controller can receive an operational profile of an HPR lamp from a printing device that is different from the printing device including the controller. The HPR lamp of the received operational profile can be a same type of HPR lamp as the HPR lamp included in the printing device.

In some examples, the received operational profile can be an aggregated received operational profile. The aggregated operational profile can be aggregated electrical measurements from same component types from different printing devices than the printing device, and/or aggregated operational profiles of same component types from different printing devices than the printing device. For example, the aggregated operational profile can be aggregated electrical measurements from HPR lamps from different printing devices, where the HPR lamps from the different printing devices are a same type of HPR lamp included in the printing device. That is, the aggregated operational profile can be operational profiles of HPR lamps aggregated from different printing devices that are a same type of printing device as the printing device.

At 564, the method 558 includes comparing, by the controller, the operational profile against a baseline operational profile of the component of the printing device. The operational profile can be compared against the baseline operational profile of the component to determine whether the component of the printing device is working as expected. That is, the controller can compare the generated operational profile against the baseline operational profile to determine whether an anomaly and/or a fault of the component of the printing device exists.

In some examples, method 558 can include comparing the received operational profile against the generated operational profile to determine an anomaly and/or a fault of the printing device. As described above, the received operational profile can be an aggregated operational profile of a component from other printing devices that are the same type of printing device as the printing device. The controller can compare the received aggregated operational profile with the component of the printing device exists. By comparing the received aggregated operational profile with the generated operational profile, the controller can determine, based on other components of other printing devices, whether the component of the printing device is functioning properly. The component of the printing device may be compared against other components of other printing devices that may be new, or have been in service for a period of time. The comparison with the received aggregated operational profile may help determine whether the component of the printing device is functioning properly, or is not functioning properly (e.g., has a defect, is worn out, is not wearing as expected, etc.) The comparison with the received aggregated operational profile can further identify components that indicate they may be at risk of an early fault based on faults of components of other printers included in the aggregated operational profile.

At 566, the method 558 includes recording, by the controller, the operational profile as an anomaly in response to the operational profile exceeding a first threshold. For example, if the electrical measurement of the operational profile exceeds the electrical measurement of the baseline operational profile by a threshold amount, the controller can record the operational profile as an anomaly.

At 568, the method 558 includes recording, by the controller, the operational profile in response to the operational profile exceeding a second threshold. For example, if the electrical measurement of the operational profile exceeds the electrical measurement of the baseline operational profile by a second threshold amount that is different from a first threshold amount, the controller can record the operational profile.

At 570, the method 558 includes determining, by the controller, the operational profile indicates a fault of the component of the printing device corresponding to the operational profile. The method 558 can include generating and displaying an alert in response to the controller determining the operational profile indicates the fault of the component of the printing device corresponding to the operational profile. The generated alert can inform a user that there is a fault with a component of the printing device, and the user can schedule maintenance such that the component may be repaired and/or replaced.

As used herein, "logic" is an alternative or additional processing resource to perform a particular action and/or element described herein. Logic can include hardware. The hardware can include processing resources such as circuitry, which are distinct from machine-readable instructions on a machine readable media. Further, as used herein, "a" can refer to one such thing or more than one such thing.

The above specification, examples and data provide a description of the method and applications, and use of the system and method of the disclosure. Since many examples can be made without departing from the spirit and scope of the system and method of the disclosure, this specification merely sets forth some of the many possible example configurations and implementations.

What is claimed is:

1. A controller, comprising:
- a processing resource; and
- a memory resource storing machine readable instructions to cause the processing resource to:
  - determine an electrical measurement of a component of a printing device;
  - generate an operational profile of the electrical measurement of the component;
  - compare the operational profile against a baseline operational profile of the component;
  - record, in response to the operational profile exceeding a first threshold, the operational profile as an anomaly; and
  - in response to the operational profile exceeding a second threshold:
    - recording the operational profile; and
    - determining the operational profile indicates a fault of the component of the printing device corresponding to the operational profile.

2. The controller of claim 1, wherein the processing resource executes machine readable instructions to cause the controller to:
- generate an alert in response to the operational profile indicating the fault of the component of the printing device; and
- display, via a user interface of the printing device, the generated alert.

3. The controller of claim 1, wherein the operational profile includes the electrical measurement measured over time.

4. The controller of claim 1, wherein the electrical measurement includes at least one of a voltage measurement of the component of the printing device and a current measurement of the component of the printing device.

5. A non-transitory machine readable storage medium having stored thereon machine readable instructions to cause a processing resource to:

determine an electrical measurement of a component of a printing device;

generate an operational profile of the electrical measurement of the component of the printing device;

compare the operational profile against a baseline operational profile of the component;

record the operational profile as an anomaly in response to the operational profile exceeding a first threshold; and in response to the operational profile exceeding a second threshold:

record the operational profile; and determine the operational profile indicates a fault of the component of the printing device corresponding to the operational profile.

6. The medium of claim 5, wherein the instructions to determine the electrical measurement of the component of the printing device include instructions to cause the processing resource to determine the electrical measurements during at least one of:

a sleep mode of the printing device;

a wake up period of the printing device; and an operation of the printing device.

7. The medium of claim 5, wherein the baseline operational profile is at least one of:

an electrical measurement of the component of the printing device measured over time when the component is manufactured; and an electrical measurement of the component of the printing device measured over time when the component is installed in the printing device.

8. The medium of claim 5, wherein the component of the printing device includes at least one of:

a heated pressure roller lamp;

a dryer;

a power supply;

a print bar;

a switch; and a finisher.

9. A method, comprising:

determining, by a controller included in a printing device, an electrical measurement of a component of a plurality of components of the printing device;

generating, by the controller, an operational profile of the electrical measurement of the component of the printing device;

comparing, by the controller, the operational profile against a baseline operational profile of the component of the printing device;

recording, by the controller, the operational profile as an anomaly in response to the operational profile exceeding a first threshold; and in response to the operational profile exceeding a second threshold:

recording, by the controller, the operational profile; and determining, by the controller, the operational profile indicates a fault of the component of the printing device corresponding to the operational profile.

10. The method of claim 9, wherein the method includes determining electrical measurements of each of the plurality of components of the printing device in a predetermined sequence such that each of the electrical measurements are determined at different times.

11. The method of claim 10, wherein the method includes at least one of:

generating operational profiles of each electrical measurement of the plurality of components of the printing device in the predetermined sequence; and transmitting the generated operational profiles to a server.

12. The method of claim 9, wherein the method includes receiving an operational profile from a database of operational profiles, wherein the received operational profile corresponds to an electrical measurement of a same component type from a different printing device as the component of the printing device.

13. The method of claim 12, wherein the method includes comparing the received operational profile against the generated operational profile to determine at least one of the anomaly or a fault of the component of the printing device.

14. The controller of claim 1, wherein the processing resource executes machine readable instructions to cause the controller generate an alert based on the comparison.

* * * * *